US005686399A

United States Patent [19]

Bianchetti et al.

[11] Patent Number: 5,686,399

[45] Date of Patent: Nov. 11, 1997

[54] LIMESCALE REMOVAL COMPOSITIONS

[75] Inventors: Giulia Ottavia Bianchetti; Sergio Cardola; Stefano Scialla, all of Rome, Italy

[73] Assignee: The Procter & Gamble Company, Cincinnati, Ohio

[21] Appl. No.: 597,001

[22] Filed: Feb. 5, 1996

[51] Int. Cl.[6] ..... B08B 3/04; C11D 1/12; C11D 1/94

[52] U.S. Cl. ..... 510/191; 510/116; 510/238; 510/247; 510/372; 510/373; 510/427; 510/433; 134/3; 134/42

[58] Field of Search ..... 510/116, 191, 510/238, 372, 373, 427, 433, 247; 134/3, 42

[56] References Cited

U.S. PATENT DOCUMENTS

| | | | |
|---|---|---|---|
| 3,839,213 | 10/1974 | Hill | 252/89 |
| 3,920,586 | 11/1975 | Bonaparte et al. | 252/531 |
| 3,969,258 | 7/1976 | Carandang et al. | 252/106 |
| 4,116,878 | 9/1978 | Deutscher et al. | 252/94 |
| 4,804,491 | 2/1989 | Choy et al. | 252/94 |
| 4,895,669 | 1/1990 | Choy et al. | 252/95 |
| 5,244,593 | 9/1993 | Roselle et al. | 252/99 |
| 5,447,575 | 9/1995 | Crump et al. | 134/42 |

*Primary Examiner*—Paul Lieberman
*Assistant Examiner*—Gregory R. Delcotto
*Attorney, Agent, or Firm*—Robert B. Aylor; T. David Reed

[57] ABSTRACT

Compositions for the removal of limescale comprise aryl sulfonic acids, optionally, acid stable bleach compositions, and, optionally, sulfamic acid. The compositions are used in a process for removing limescale as aqueous compositions. The pH of the compositions is from about 0 to about 4. The compositions provide improved performance for equal reserve acidity.

12 Claims, No Drawings

LIMESCALE REMOVAL COMPOSITIONS

TECHNICAL FIELD

The present invention relates to compositions for the removal of limescale. The compositions herein can be used on a variety of surfaces, ranging from bathrooms, toilets, and kitchen surfaces to various appliances. The compositions herein can further be used to remove limescale from dentures.

BACKGROUND

Tap water always contains a certain amount of solubilized ions which eventually deposit as salts, on surfaces in contact with said water, as it evaporates. Such salts include calcium carbonate, commonly referred to as limescale. This phenomenon of limescale accumulation on surfaces which are often in contact with water may damage surfaces and affect the functioning of taps or appliances. Also, the accumulation of limescale in toilet bowls is aesthetically unpleasant and favors the deposition of further soil and the growth of microorganisms. It is therefore important to control this limescale accumulation phenomenon.

A variety of compositions have been proposed for this purposed, which typically comprise various acids, such as hydrochloric acid. However, compositions of the art formulated with said acids require a significant amount of acid to ensure effective removal of limescale, and are thus potentially harmful to the user in case of contact with the skin, or accidental ingestion. It is thus an object of the present invention to provide limescale removing compositions which are particularly efficient in removing limescale, yet which have a lower reserve of acidity than the compositions of the art, thus which are less harmful.

It is also desirable to formulate compositions which comprise bleaches. Indeed, bleaches possess many desirable properties, including disinfection properties. Furthermore, such compounds as monopersulfuric acid are particularly effective as disinfectants and in removing and or decoloring stains for household cleaning applications, see EP 598 694. However, as said, bleaches in general raise compatibility issues in relation with the acids used to remove limescale. In particular, persulfuric acid is not compatible with the acids used in the art to remove limescale because persulfuric acid oxidizes the limescale removing acid upon storage, resulting in a dramatic loss of available oxygen. And by the time the product reaches the consumer, most of the available oxygen is lost. Typical acids used in the art for removing limescale, namely maleic, citric, hydrochloric and sulfamic acid are all oxidized by persulfuric acid in particular. It is thus an object of the present invention to provide a limescale removing composition which can be formulated with bleaches, in particular persulfuric acid, in a stable manner.

In response to these objects, we have now found that such a limescale removing composition could be formulated which comprises, as the acid, an arylsulfonic acid selected from a specific group, or mixtures thereof.

EP 271 791 discloses compositions comprising short chain alkyl sulfonic acids for cleaning and disinfecting in the food processing industry. Co-pending European patent application EP 93870228.9 discloses short chain alkylsulfonic acids for removing limescale. U.S. Pat. No. 4,895,669 discloses hard surface cleaning compositions comprising long chain alkylarylsulfonic acids and potassium peroxymonosulfate.

SUMMARY OF THE INVENTION

The present invention thus encompasses a composition suitable for removing limescale, which comprises from 1% to 50% by weight of the total composition of an arylsulfonic acid selected from the specific group defined hereinafter, or mixtures thereof. In one embodiment of the invention, the compositions of the present invention preferably comprise an acid-stable bleach compound. In another embodiment of the invention, the compositions herein additionally comprise a small amount of sulfamic acid. In its broadest embodiment, the present invention further encompasses the use of aqueous compositions comprising an arylsulfonic acid selected from the specific group defined hereinafter, or mixtures thereof, for removing limescale.

DETAILED DESCRIPTION OF THE INVENTION

The compositions of the present invention are aqueous liquid compositions comprising an arylsulfonic acid selected from the specific group defined hereinafter, or mixtures thereof. Arylsulfonic acids suitable for use herein are selected from the group of arylsulfonic acids according to the formula:

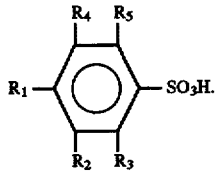

wherein $R_1$, $R_2$, $R_3$, $R_4$ and $R_5$ are each H or $SO_3H$, or linear or branched $C_0$—$C_4$ alkyl chain; or mixtures thereof.

Preferred for use herein are arylsulfonic acids which comprise no or only one alkyl chain. Indeed, we have found that said arylsulfonic acids are particularly effective at removing limescale, which is not the case for their longer alkyl chain homologues. Particularly suitable for use herein are benzene sulfonic acid, toluene sulfonic acid and cumene sulfonic acid. Amongst these three, at equal weight %, we have found that the shorter the alkyl chain, down to no chain at all, the better the limescale removing performance.

The compositions herein comprise from 1% to 50% by weight of the total composition of said arylsulfonic acid or mixtures thereof, preferably from 1% to 30%, most preferably 1% to 10%.

We have also observed that mixtures of the arylsulfonic acids herein provided a poorer limescale removing performance than single species. Accordingly, compositions herein preferably contain only one arylsulfonic acid as defined hereinabove.

The compositions according to the present invention are less harsh than the compositions of the art in that, at parity limescale removal performance, the reserve of acidity is much less than the compositions in the art. Thus in this respect, in case of contact with the user's skin or in case of ingestion, the composition of the present invention will be less harmful.

The compositions herein are acidic. Accordingly, the pH of the compositions according to the present invention may range from 0 to 4, preferably 0 to 2, and is essentially determined by the type and amount of arylsulfonic acid used.

In one embodiment of the present invention, the composition herein may comprise an acid-stable bleach, i.e. an oxidant compound. By acid-stable, it is meant herein a compound which is stable in the acidic environment of the compositions herein. This criterion is to be assessed on a case by case basis, depending on the specifics of given formulations. It is essential that the bleach/oxidant chosen be stable at the pH of the formulation being considered. By stable, it is meant herein that the oxidant should preferably not undergo more than 30% loss of available oxygen in 2 months at room temperature (25° C.). A wide variety of oxidants have been described in the art which are suitable for use herein. Suitable acid-stable oxidant compounds for use herein include inorganic and organic peroxides. Examples of inorganic peroxides are: hydrogen peroxide and sources thereof (e.g. perborate, percarbonate), persulfate salts (i.e. dipersulfate and monopersulfate salts), persulfuric acid and mixtures thereof. Examples of organic peroxides are: benzoyl peroxide, organic percarboxylic acids (.e. peracetic acid) and mixtures thereof. Percarboxylic acids and, in general, organic or inorganic peroxides can be either solubilized in the formula or dispersed in the form of suspended solids or emulsified liquids. Particularly preferred for use herein are hydrogen peroxide or sources thereof, and persulfuric acid or salts thereof because of their excellent stain removal performance and stability in acidic matrices, and mixtures thereof.

Preferred salts of persulfuric acid for use herein are monopersulfuric salts, commercially available as Curox® from Interox, Caroat from Degussa and Oxone from Du Pont. The compositions herein may comprise from 0.1% to 50% by weight of the total compositions of said acid-stable bleach/oxidant compound or mixtures thereof, preferably from 1% to 30%, most preferably 1% to 20%.

In another embodiment of the present invention, the compositions herein may comprise a small amount of sulfamic acid. Indeed, we have found that the combination of the arylsulfonic acids herein together with sulfamic acid act in synergy in removing limescale. This property is particularly interesting as it allows the formulation of compositions which are particularly effective in removing limescale, while they comprise only minor amounts of sulfamic acid, thereby reducing harshness. Accordingly, the compositions herein may comprise from 0.1% to 25% by weight of the total composition of sulfamic acid, preferably from 0.1% to 20%, most preferably from 0.2% to 15%. The synergistic effect observed depends to some extent on the ratio of sulfamic acid to arylsulfonic acid. In this embodiment where sulfamic acid is incorporated in the compositions herein, it is preferred to formulate the compositions without monopersulfuric acid and similar oxidants, since monopersulfuric acid oxidizes sulfamic acid, thereby resulting in loss of available oxygen.

The compositions herein may further comprise surfactants since they are often used on items or surfaces which have soils or stains which do not comprise limescale, and which require the presence of surfactants in the compositions of the present invention, in order to be removed from said surfaces. Also, surfactant systems can be used to provide viscosity to the compositions herein, and that is desirable since the compositions herein are likely to be used on inclined surfaces such as bath tubs, sinks or toilet bowls. Thickened compositions have a better cling onto inclined surfaces, thus a longer residence time for the composition to remove limescale.

Thus, the compositions according to the present invention can comprise any surfactant, cationic, anionic, nonionic and zwitterionic, in amounts ranging up to 50% by weight of the total composition, preferably from 1% to 30%.

Suitable anionic surfactants include alkyl or alkylene sulfates or sulfonates, alkyl or alkylene ether sulfates or sulfonates, linear alkyl benzene sulfonate and the like. Suitable cationic surfactants include quaternary ammonium salts. Suitable nonionic surfactants for use herein include ethoxylated carboxylic acids, amine oxides and fatty alcohol ethoxylates. Emulsions of nonionic surfactants, such as in co-pending European patent application EP 598 692 are also suitable to provide pseudoplastic and thixotropic compositions, which allow excellent spreading and clinging characteristics on dry surfaces.

Another suitable thickening surfactant system that leads to excellent spreading and clinging on wet surface for use herein is constituted by mixtures of amine oxides and quaternary ammonium compounds. In particular, amine oxides according to the formula R1R2R3NO where R1 is a C6—C10 alkyl chain and R2 and R3 are C1—C4 alkyl chains, in combination with quaternary ammonium salts allow to build viscosity at a lower total level than if quaternary ammonium salts were used alone. Preferred amine oxides in such a system are those where R1 is C8—C10 alkyl, and R2 and R3 are C1–C3 alkyl chains, preferably methyl. Suitable quaternary ammonium compounds in such a system have one or two long alkyl chains, i.e. 6 to 30, preferably 12 to 20 carbon atoms linked to the nitrogen atom, and the other alkyl chains linked to the nitrogen atom are shorter, i.e. they have 1 to 4, preferably 1 carbon atom. Such a system can be used in total amounts, i.e. amine oxide plus quaternary ammonium compound, of up to 20% by weight of the total composition, but amounts as low as from 1% to 6% can be sufficient to build the desired viscosity. Suitable weight ratios of amine oxide to quaternary ammonium compound range from 1:2 to 1:100, preferably 1:4 to 1:30, most preferably 1:10 to 1:20. Desired viscosity herein ranges from 250 cps and up, preferably 250 cps to 1500 cps, more preferably 250 cps to 900 cps (at 50 dynes/cm2, at 20° c). Such a system is particularly suitable herein since the viscosity it provides is not affected by the presence of the bleach The present invention can further comprise a multitude of optionals such as solvents, colorants, dyes, perfumes, stabilizers, radical scavengers and the like.

EXAMPLES

The following compositions are made which comprise the following ingredients in the following proportions (total weight %)

| Example 1 | |
|---|---|
| Dobanol ® 91-10 | 2.1 |
| Dobanol ® 91-2.5 | 4.9 |
| Curox ® | 6 |
| Cumenesulfonic acid | 5 |
| water and minors | |
| (e.g. dye, perfume, radical scavengers) up to 100% | |
| pH = 0.9 | |

| Example 2 | |
|---|---|
| Dobanol ® 91-10 | 2.1 |
| Dobanol ® 91-2.5 | 4.9 |
| Curox ® | 6 |
| Toluenesulfonic acid | 5 |
| water and minors | |
| (e.g. dye, perfume, radical scavengers) up to 100% | |
| pH = 0.7 | |

| Example 3 | |
|---|---|
| Dobanol ® 91-10 | 2.1 |
| Dobanol ® 91-2.5 | 4.9 |
| Benzenesulfonic acid | 5 |
| water and minors | |
| (e.g. perfume, dye, radical scavengers) up to 100% | |
| pH = 0.7 | |

-continued

| | |
|---|---|
| **Example 4** | |
| $C_{16}$ trimethyl ammonium methylsulfate | 4 |
| $C_8/C_{10}$ amineoxide | 0.2 |
| Benzenesulfonic acid | 10 |
| water and minors (e.g. perfume, dye, radical scavengers) up to 100% | |
| pH = 0.6 | |
| **Example 5** | |
| $C_{16}$ trimethyl ammonium methylsulfate | 4 |
| $C_8/C_{10}$ amineoxide | 0.2 |
| Toluenesulfonic acid | 15 |
| water and minors (e.g. perfume, dye, radical scavengers) up to 100% | |
| pH = 0.6 | |
| **Example 6** | |
| $C_{12}/C_{14}$ Amineoxide | 3 |
| Dobanol ® 91-2.5 | 3 |
| Benzenesulfonic acid | 10 |
| water and minors (e.g. perfume, dye, radical scavengers) up to 100% | |
| pH = 0.8 | |
| **Example 7** | |
| Sulfamic acid | 5 |
| water and minors up to 100% | |
| pH = 0.7 | |
| **Example 8** | |
| Benzenesulfonic acid | 5 |
| water and minors up to 100% | |
| pH = 0.7 | |
| **Example 9** | |
| Benzenesulfonic acid | 10 |
| water and minor up to 100% | |
| pH = 0.5 | |
| **Example 10** | |
| Benzenesulfonic acid | 5 |
| Sulfamic acid | 5 |
| water and minor up to 100% | |
| pH = 0.7 | |

The limescale removal efficiency of samples is evaluated by putting a block of 6 g of calcium carbonate in 50 mls of the sample to be evaluated for a period of 30 minutes. The block is weighed dry before and after the experiment. The bigger the difference, the more efficient the composition.

The weight decrease measured with composition 1 was 0.40; for composition 2 it was 0.50, and for composition 3 it was 0.60. This indicates that the shorter the alkyl chain (i.e., $C_0$ for composition 3) in the arylsulfonic acid, the better the limescale removal performance. This is verified comparing composition 4 (alkyl=$C_0$) which provided a weight decrease of 0.5, with composition 5 (alkyl=$C_1$) which required a higher amount of acid to achieve the same performance. The synergistic effect of sulfamic acid used together with benzenesulfonic acid can be seen comparing the weight decrease of composition 7 (0.73) and 8 (0.57) and 9 (1.02) vs. composition 10 (1.55).

In terms of bleach stability, the available oxygen was monitored in composition 1. The available oxygen is measured in the fresh composition, and in the same composition after one week storage at room temperature (25° C.). Persulfate concentration can be measured by titration with potassium permanganate after reduction with a solution containing ammonium ferrous sulfate. This test method is well known and reported for instance in on the technical information sheet of Curox®, commercially available from Interox. Another suitable method is disclosed in Gas-Liquid Chromatography Method for the Determination of Peracids, Analyst, Vol 113, May 1988, pp 793–795. We have measured there was no loss of available oxygen with composition 1 whereas, in the same composition where cumenesulfonic acid was replaced respectively by the same amount (weight) of sulfamic or hydrochloric acid, the loss of available oxygen in the same period ranges between 66% and 98%. Thus the compositions according to the present invention allow for much more bleach stability.

What is claimed is:

1. The method of removing limescale comprising application to the limescale of an effective amount of an aqueous composition consisting essentially of:

(1) from about 1% to about 50% of arylsulfonic acid according to the formula:

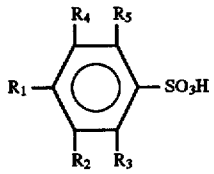

wherein $R_1$, $R_2$, $R_3$, $R_4$ and $R_5$ are each H or $SO_3H$, or linear or branched $C_1$—$C_4$ alkyl chain; or mixtures thereof;

(2) from about 0.1% to about 25%, sulfamic acid;

(3) 1% to about 20% by weight of the total composition of a mixture of amine oxide and quaternary ammonium compound in a ratio of 1:2 to 1:100, and (4) the balance water, said composition having a pH of from about 0 to about 2 and said pH being essentially determined by the type and amount of said arylsulfonic acid present.

2. An aqueous acidic composition suitable for removing limescale, which consists essentially of:

(1) from about 1% to about 50% by weight of the total composition of arylsulfonic acid according to the formula:

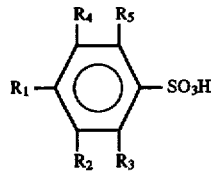

wherein $R_1$, $R_2$, $R_3$, $R_4$, $R_5$ are each H or $SO_3H$, or linear or branched $C_1$—$C_4$ alkyl chain; or mixtures thereof:

(2) from about 0.1% to about 25%, sulfamic acid;

(3) 1% to about 20% by weight of the total compound of a mixture of amine oxide and quaternary ammonium compound in a ratio of 1:2 to 1:100, and (4) the balance water, said composition having a pH of from about 0to about 2.

3. A composition according to claim 2, which comprises from about 1% to about 30% of said arylsulfonic acid by weight of the total composition.

4. A composition according to claim 3, which comprises from about 1% to about 10% of said arylsulfonic acid by weight of the total composition.

5. A composition according to claim 2 wherein said composition further comprises an acid-stable oxidant compound, or mixtures thereof.

6. A composition according to claim 5 wherein said oxidant is hydrogen peroxide or a salt of persulfuric acid.

7. A composition according to claim 6 wherein said oxidant is a monopersulfate salt.

8. An aqueous acidic composition suitable for removing limescale, which consists essentially of:

(1) from about 1% to about 50% by weight of the total composition of arylsulfonic acid according to the formula:

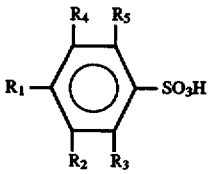

wherein $R_1$, $R_2$, $R_3$, $R_4$, $R_5$ are each H or $SO_3H$, or linear or branched $C_1$—$C_4$ alkyl chain; or mixtures thereof;

(2) sulfamic acid, in amounts of from about 0.1% to about 25% by weight of the total composition;

(3) 1% to about 20% by weight of the total composition of a mixture of amine oxide and quaternary ammonium compound in a ratio of 1:2 to 1:100, and (4) the balance water, said composition having a pH of from about 0 to about 2 and said pH being essentially determined by the type and amount of said arylsulfonic acid present.

9. A composition according to claim 8 which comprises sulfamic acid, in amounts of from about 0.1% to about 20% by weight of the total composition.

10. A composition according to claim 9 which comprises sulfamic acid, in amounts of from about 0.2% to about 15% by weight of the total composition.

11. A composition according to claim 1 wherein said arylsulfonic acid is selected from the group consisting of benzenesulfonic acid, cumene sulfonic acid or toluene sulfonic acid, or mixtures thereof.

12. A composition according to claim 1, where said composition comprises a single said arylsulfonic acid.

* * * * *